United States Patent [19]

Burns

[11] Patent Number: 4,716,915

[45] Date of Patent: Jan. 5, 1988

[54] COSMETIC DEVICE

[76] Inventor: Wm. Robert Burns, 4520 N. Central, Phoenix, Ariz. 85021

[21] Appl. No.: 757,248

[22] Filed: Jul. 22, 1985

[51] Int. Cl.[4] ..... A45D 40/00

[52] U.S. Cl. ..... 132/79 R; 132/79 G; 132/85; 132/148

[58] Field of Search ..... 132/79 R, 79 B, 79 F, 132/79 G; 132/85, 148, 88.5, 88.7

[56] References Cited

U.S. PATENT DOCUMENTS

| | | | |
|---|---|---|---|
| 1,321,026 | 11/1919 | Freed | 132/79 G |
| 1,510,420 | 9/1924 | Sherman | 132/79 R |
| 2,191,254 | 2/1940 | Harmon | 132/148 |
| 2,815,032 | 12/1957 | Rosenfeld | 132/148 |
| 3,091,248 | 5/1963 | Strauch | 132/85 |
| 3,406,694 | 10/1968 | Odence | 132/85 |
| 3,516,424 | 6/1970 | Eagle | 132/85 |
| 3,856,027 | 12/1974 | Legere | 132/148 |
| 4,116,205 | 9/1978 | Owen et al. | 132/85 |
| 4,289,153 | 9/1981 | Paccione | 132/85 |

*Primary Examiner*—John J. Wilson
*Assistant Examiner*—Hakomaki J.
*Attorney, Agent, or Firm*—Nissle & Leeds

[57] ABSTRACT

A cosmetic device. The device includes a hand held carrying case which is shaped and dimensioned to be concealed on the person and to conceal a hair brush, hair spray reservoir and mirror within the carrying case. The hair spray reservoir and hair brush can be extended from the carrying case such that an individual can readily hold and manipulate the carrying case with one hand to brush his hair, to operate the spray reservoir, and to view his head and hair in the mirror.

6 Claims, 8 Drawing Figures

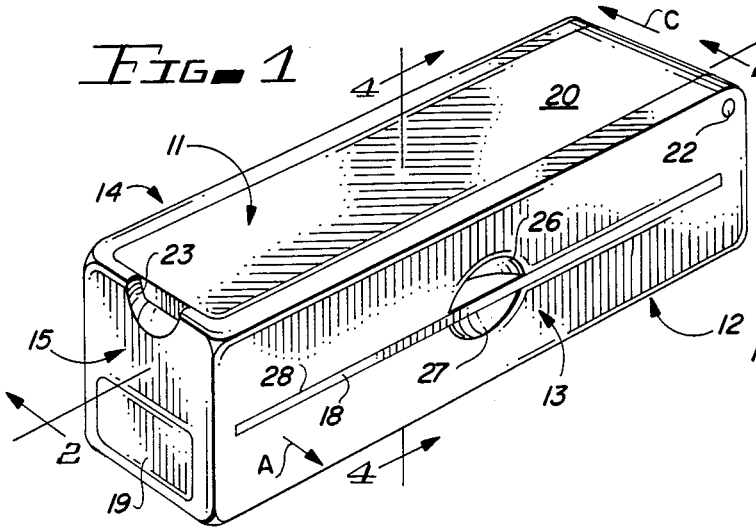
FIG. 1
C
2
16
4
20
11
22
14
26
23
15
12
28
27
13
18
2
A
4
19
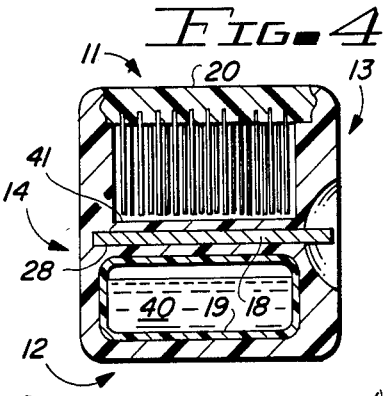
FIG. 4
11
20
13
41
14
28
40
19
18
12
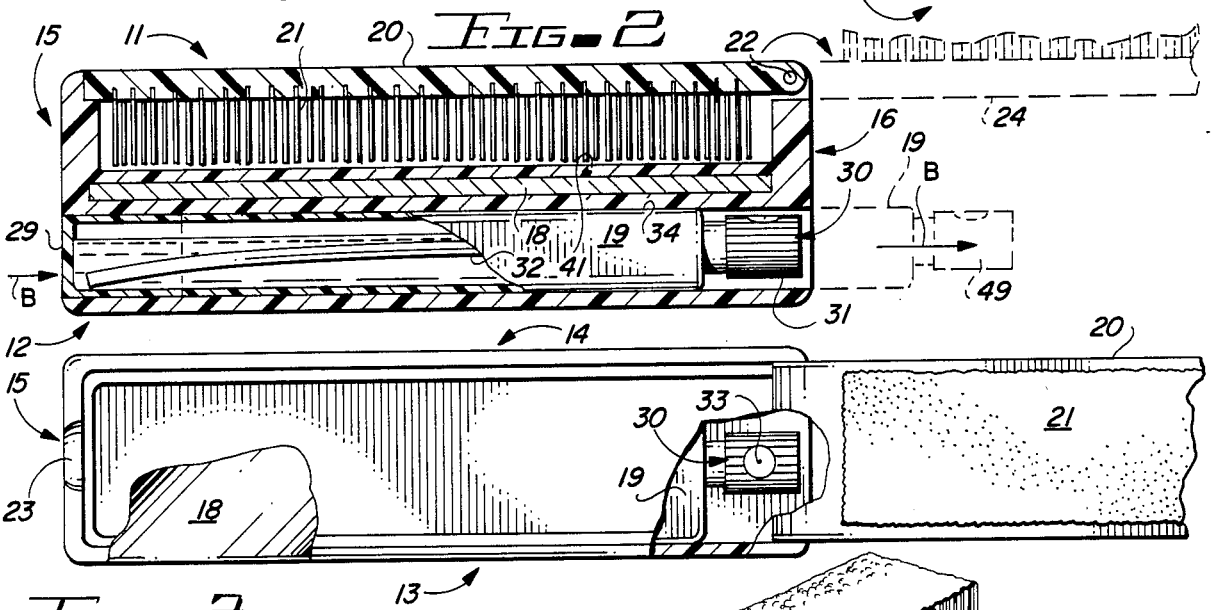
FIG. 2
15
11
21
20
22
24
16
19
B
30
29
18
19
34
32
41
B
49
31
12
14
20
15
33
30
21
19
23
18
13
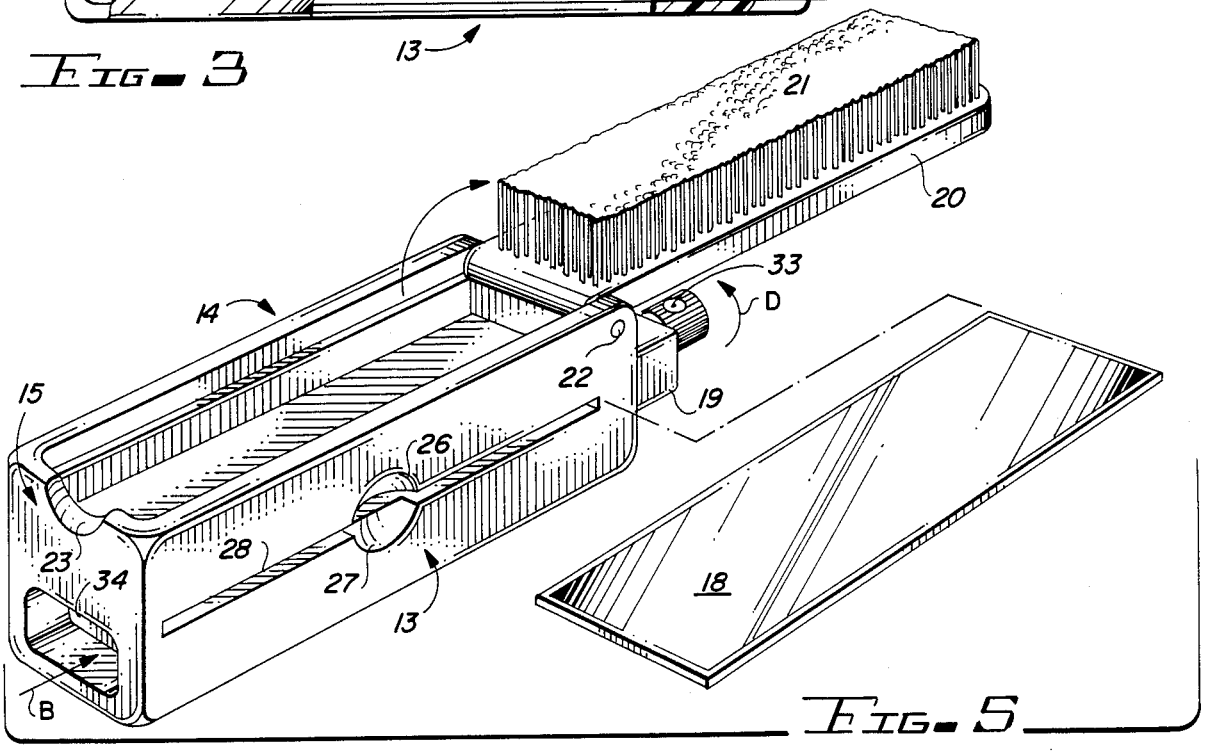
FIG. 3
21
20
33
14
D
22
19
15
26
23
28
34
27
13
18
B
FIG. 5

COSMETIC DEVICE

This invention pertains to cosmetic devices used in the care and grooming of an individual's hair.

More particularly, the invention pertains to a portable cosmetic device including a hand held carrying case which is shaped and dimensioned to be concealed on the person and to conceal a hair brush, hair spray reservoir and mirror within the carrying case.

In a further respect, the invention pertains to a cosmetic device of the type described which permits the hair spray reservoir and hair brush to be extended from the carrying case such that an individual can readily hold and manipulate the device with one hand to brush his hair, to operate the spray reservoir, and to view his head and hair in the mirror.

Businessmen and travelers often, when a rest room or similar facility is not available, have occasion to room themselves prior to a conference or business appointment. Carrying the necessary grooming articles, including a hair brush, hair spray and mirror, on the person is usually impractical. Attempting to utilize each of these individual implements to groom one's hair on short notice and during a limited period of time is also impractical. This is particularly the case because grooming implements are typically marketed separately and in relatively large sizes which cannot be readily carried on the person or in a purse.

The prior art discloses a variety of devices which combine grooming implements. See, for example, U.S. Pat. No. 4,116,205 to Owen et al., U.S. Pat. No. 3,942,540 to Gause, U.S. Pat. No. 3,516,424 to Eagle, and U.S. Pat. No. 3,091,248 to Strauch. Such prior art devices generally cannot be concealed on the person, are aesthetically unappealing, or do not provide a traveler with a single compact device which carries a brush, spray reservoir and mirror. More importantly, none of the prior art devices combine a mirror, brush and hair spray reservoir in a single cosmetic device which can be held in and manipulated with one hand to comb and spray hair while periodically viewing the hair in a mirror carried in the device.

Accordingly, it would be highly desirable to provide an improved cosmetic device which would conceal a mirror, hair brush and spray reservoir in an attractive carrying case which was concealable on the person and would permit the brush and spray reservoir to be extended from the carrying case for use such that the carrying case could be grasped in one hand and manipulated with the hand to utilize the mirror to spray and comb one's hair.

Therefore, it is a principal object of the invention to provide an improved cosmetic device.

Another object of the invention is to provide an improved cosmetic device having a carrying case which is concealable on the person and houses and conceals a brush, spray reservoir and mirror.

A further object of the invention is to provide an improved cosmetic device of the type described which permits the hair brush and spray reservoir to be extended from and secured in the carrying case such that the case can be utilized as a handle to control the brush and spray reservoir.

Still another object of the invention is to provide an improved cosmetic device of the type described in which the mirror is exposed for use when the hair brush is extended from the carrying case.

Yet a further object of the instant invention is to provide an improved cosmetic device of the type described which can, after the brush and spray reservoir are extended from the carrying case, be held in and manipulated by one hand to utilize the mirror and to spray and comb hair.

These and other, further and more specific objects and advantages of the invention will be apparent to those skilled in the art from the following detailed description thereof, taken in conjunction with the drawings, in which:

FIG. 1 is a perspective view illustrating a cosmetic device constructed in accordance with the principles of the invention;

FIG. 2 is a section view of the cosmetic device of FIG. 1 taken along section line 2—2 thereof and further illustrating internal construction details thereof;

FIG. 3 is a top view illustrating the cosmetic device of FIG. 1 with the hair brush thereof extended for use;

FIG. 4 is a section view of the cosmetic device of FIG. 1 taken along section line 4—4 thereof and further illustrating the grooming implements concealed therein;

FIG. 5 is a perspective view illustrating the cosmetic device of FIG. 3 with the spray reservoir extended for use and with the auxiliary mirror removed therefrom;

Figure 6:
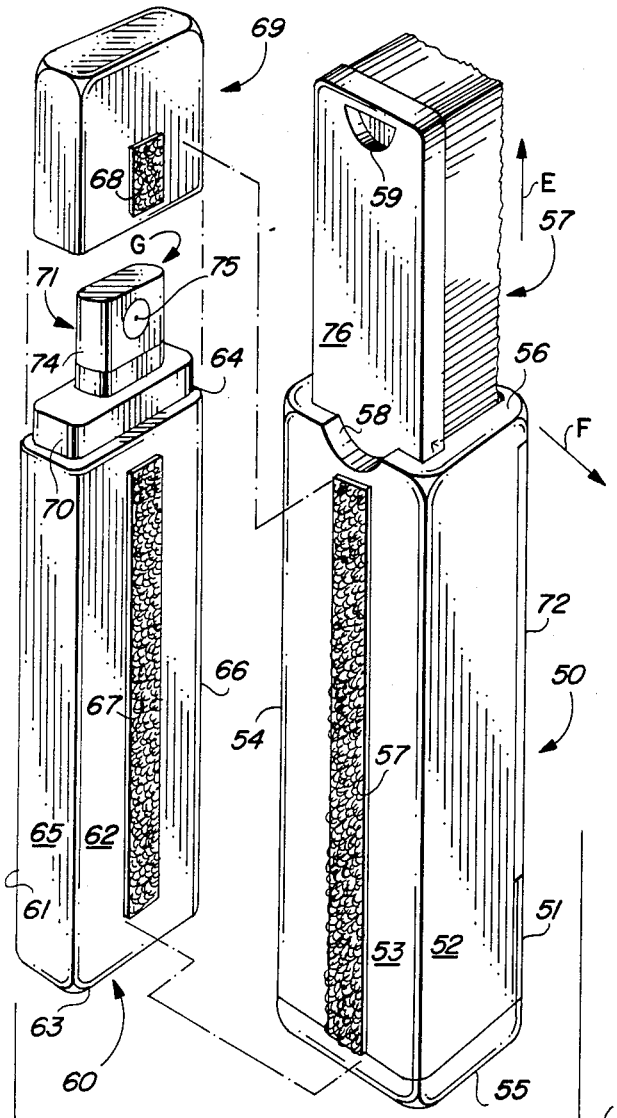
FIG. 6 is a perspective assembly view depicting an alternate embodiment of the cosmetic device of the invention.

Briefly, in accordance with my invention, I provide an improved cosmetic device. The device includes a hand held carrying case having top, bottom, front, back and side surfaces and shaped and dimensioned to be concealed on the person; a hair brush stored in the carrying case and including a backing and bristles extending therefrom; a reservoir of chemical solution stored in the carrying case; valve-nozzle means operatively associated with the reservoir for delivering under pressure from the reservoir chemical solution stored therein on the hair of an individual; and a mirror carried in the case. The hair brush bristles, reservoir of chemical solution and mirror are normally generally stored concealed from view within a space enclosed and circumscribed by the surface of the carrying case. The hair brush is extendable from the case to a position with the bristles exposed and positioned away from the case such that the bristles can be applied to the hair of an individual. The valve-nozzle means are extendable to a position outside of the case such that the valve-nozzle means can be manually operated to spray chemical solution on to the hair of an individual. The mirror is exposed to view when the brush is extended from the case. The case, valve-nozzle means, brush and mirror are shaped, contoured and dimensioned and adapted such that when the brush and valve-nozzle means are extended from the case an individual can hold the case in the palm of one hand and manipulate the cosmetic device with the hand to apply the brush to his hair, to operate the valve-nozzle means, and to view his head and hair in the mirror.

Turning now to the drawings, which depict the presently preferred embodiments and best mode of the invention for the purpose of illustrating the practice thereof and not by way of limitation of the scope of the invention, and in which identical reference characters correspond to like elements throughout the several views, FIGS. 1 to 5 illustrate the presently preferred embodiment and best mode of the invention including a carrying case having top 11, bottom 12, front 13, back 14 and side 15 and 16 generally planar surfaces enclosing and circumscribing an internal storage space containing a removable mirror 18, fluid reservoir 19, and brush including backing 20 having bristles 21 outwardly depending therefrom. Backing 20 is pivotally mounted on pin 22 and is, by inserting a thumb or finger in notch 23, pried upwardly and opened to the position indicated by dashed lines 24 in FIG. 2. Mirror 18 is removed from its rectangular storage compartment 28 by inserting the thumb and forefinger of one hand in slots 26 and 27, grasping mirror 18, and pulling the mirror in the direction of arrow A in FIG. 1. Valve-nozzle means 30 is operatively associated with fluid reservoir 19. When nozzle head 31 is depressed, fluid is drawn from reservoir 19 through conduit 32 and directed as a spray through nozzle 33 in head 31. Valve-nozzle means 30 can be removed from and reattached to reservoir 19 so that reservoir 19 can be recharged with fluid when empty. Reservoir 19 is friction fit in elongate rectangular aperture 34 extending through the carrying case. Valve-nozzle means 30 is extended to a position outside of end surface 16 of the carrying case by pressing bottom 59 of reservoir 19 in the direction of arrow B in FIGS. 2 and 3. The extended position of valve-nozzle means 30 is indicated by dashed lines 49 in FIG. 2. Nozzle head 31 can be rotated as indicated by arrow D in FIG. 5 so that fluid 40 from reservoir 19 can be sprayed through opening 33 toward the back of the carrying case in the direction of arrow C in FIG. 1. The direction of arrow C is generally parallel to backing 20 when the hair brush is in its open extended position illustrated in FIGS. 2, 3 and 5. Nozzle head 31 can also be rotated to direct spray through opening 33 in any other desired direction. When the hair brush is in the extended position illustrated in FIGS. 2, 3 and 5, elongate planar mirror surface 41 is exposed to view.

In use, the case of FIG. 1 is held in the palm of one hand and the other hand utilized to open the hair brush to the position indicated by dashed line 24 in FIG. 2 and to push the end 59 of reservoir 19 to extend valve-nozzle means 30 to the position indicated by dashed line 49 in FIG. 2. Pivoting backing 20 from its closed position of FIG. 1 to the open position of FIGS. 2, 3 and 5 exposes internally mounted mirror surface 41. Once the cosmetic device of FIG. 1 is in the configuration illustrated in FIG. 2, it can be held in the palm of one hand and manipulated to permit an individual to groom his hair. The index finger of the hand holding the cosmetic device can be utilized to depress valve head 31 to cause fluid spray to emit from nozzle 33. Before or after fluid 40 is sprayed on the hair, brush 21 can be utilized to groom the hair and mirror 41 utilized to periodically view the hair—all while the cosmetic device is grasped in and manipulated with one hand. If an individual wishes to utilize a mirror in the hand not holding the cosmetic device, mirror 18 can be removed from the case and utilized in such a manner.

Another embodiment of the invention is illustrated in FIG. 6 and includes brush case 50 having front 51, back 53, bottom 55, top 56 and side 52 and 54 surfaces. Positive hook and loop strip 57 is secured to back surface 53. Brush 57 is slidably stored inside case 50 and extended therefrom by inserting the tip of an index finger in notch 59 and pulling the brush in the direction of arrow E. Fluid reservoir case 60 includes front 61, rear 62, bottom 63, top 64, and side 65 and 66 surfaces. Negative hook and loop strip 67 is secured to back surface 62 and is received in piggy back fashion by positive strip 57 on brush case 50. Case 60 receives refillable fluid reservoir 70 provided with valve-nozzle means 71. Cap 69 friction fits over the upper portion of reservoir 70 and is provided with negative hook and loop 68 for attachment to the upper portion of strip 57. Panel-shaped mirror 72 is embedded in the back surface 51 of reservoir case 50. Valve-nozzle means 71 can, when strip 67 of case 60 is attached to strip 57, be rotated 90° in the direction of arrow G such that when nozzle head 74 is depressed with an index finger, spray emitted through nozzle 75 travels in the direction of arrow F parallel to back surface 76 of brush 57 in the direction of arrow F. When cap 69 is removed and nozzle head 71 is rotated 90° in this manner, case pair 50, 60 can be held in the palm of one hand with the back surface 61 of case 60 contacting the palm. The index finger of the hand operates nozzle head 71. Mirror 72 is utilized to periodically examine an individual's hair during grooming with brush 57.

Figure 8:
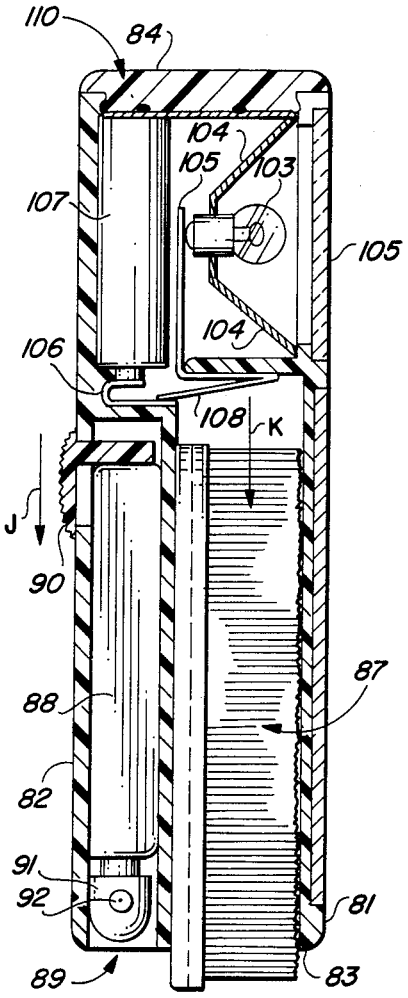
Figure 7:
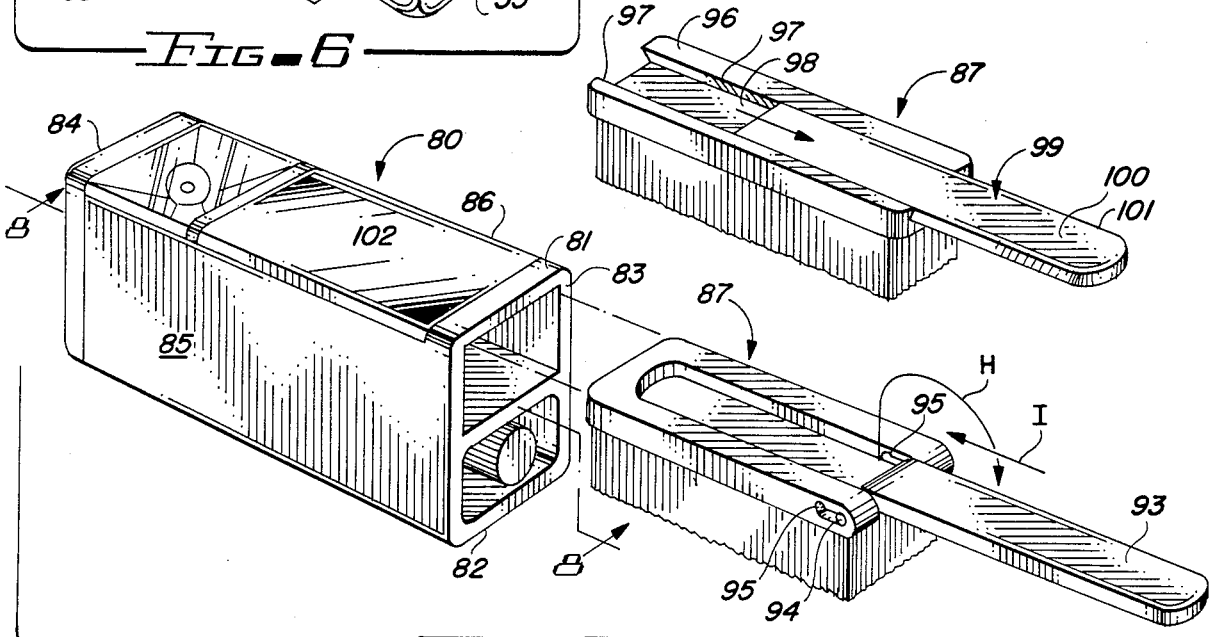
FIG. 7 is a perspective assembly view illustrating still another embodiment of the combination cosmetic device of the invention; and, FIG. 8 is a side section view of the cosmetic device of FIG. 7 taken along section line 8—8 thereof.

Still another embodiment of the invention is depicted in FIGS. 7 and 8 and includes a case 80 having front 81, rear 82, bottom 83, top 84 and side 85 and 86 surfaces enclosing brush 87 and fluid reservoir 88 provided with valve-nozzle means 89. Brush 87 is frictionally retained inside case 80 such that when case 80 is in the position illustrated in FIG. 8 brush 87 will not slide from case 80 under its own weight but must be grasped and pulled from case 80. Slide button 90 is displaced in the direction of arrow G to extend valve-nozzle means 89 to a position outside of surface 83 such that spray nozzle head 91 can be pumped with an index finger to direct spray through nozzle 92. After brush 78 is removed from case 80, handle 93 is pivoted in the direction of arrow H in FIG. 7 and is then pushed in the direction of arrow I to slide the ends of pin 94 through notches 95 in the direction of arrow I and lock handle 93 in fixed position on brush 87. As illustrated in FIG. 7, the top surface 96 of brush 87 can be provided with an elongate groove having sloped planar side surfaces 97 which intersect and form an acute angle with planar bottom surface 98. Handle 99 is slidably received by the groove formed in the top 96 of brush 87. Elongate planar edges 101 intersect and form an obtuse angle with planar top surface 100 of handle 99.

Mirror 102 is embedded in front surface 18 of casing 80. Light bulb 103 is mounted in metal support member 104 behind transparent window 105. The bottom of bulb 103 bears against metal member 105 having elongate spring leg 108 connected thereto. As shown in FIG. 8, when brush 87 is removed from casing 80, the end of spring leg 108 bears against metal member 106 closing the electrical circuit such that electricity flows from battery 107 through metal members 106, 108, 105, 104 and bulb 103. When brush 87 is returned to case 80, the end of brush 87 depresses leg 108 away from member 106 to break the circuit and extinguish light 103. Cap 110 can be removed to replace battery 107 or bulb 103.

Having described my invention in such terms as to enable those skilled in the art to understand and practice it, and having identified the presently preferred embodiments and best mode thereof, I claim:

1. A cosmetic device including (a) a hand held case having first and second side surfaces and planar rectangular top, bottom, front and back surfaces and shaped and dimensioned to be concealed on the person, each of said top, bottom, front and back surfaces generally being parallel to one other of said top, bottom, front and back surfaces;

(b) a first mirror mounted in said case;

(c) an elongate generally symmetrical channel extending through said case intermediate and generally parallel said top and bottom surfaces and opening at each of said side surfaces;

(d) a chemical solution reservoir shaped to slidably conform to said channel and having (i) a top, (ii) a bottom surface, and (iii) manually operated valve-nozzle means attached to said top for delivering under pressure from said reservoir chemical solution stored therein on the hair of an individual, said reservoir normally being concealably stored in said channel such that said bottom surface of said reservoir comprises in part one of said side surfaces, said valve-nozzle means being positioned for manual operation by pressing said bottom surface of said reservoir to slidably displace said bottom surface of said reservoir into said channel and displace said valve-nozzle means through said channel to an operative position outside of said case;

(e) a hair brush pivotally mounted in said case and including a backing and bristles extending therefrom, said backing having an outer surface, said brush being pivotally movable between two positions, (i) a first storage position with said brush concealing said mirror, with said outer surface of said backing generally comprising said top surface of said case, and with said bristles concealed inside case adjacent said mirror, and (ii) a second position with said backing and bristles extending away from said case, with said outer surface generally parallel to said mirror, and with said mirror exposed to view such that when said case is held in either hand of a user with said bottom surface of said case contacting the palm of the hand, said bristles extend outwardly away from the palm and the user can, utilize the brush on the user's hair, operate with the fingers of the hand said valve-nozzle means when said valve-nozzle means is slidably displaced to said operative position outside of said case, and view the user's head in said mirror by holding said hand in front of the user's face with the palm of the hand turned toward and opposing the face.

2. The cosmetic device of claim 1 including (a) a second mirror having an outer peripheral edge; and, (b) a storage slot formed in said case intermediate said case parallel to (i) said first mirror, (ii) said top and bottom surfaces of said case, and, (iii) said channel, said slot being shaped and dimensioned to slidably receive and conceal said second mirror such that generally only a portion of said outer peripheral edge is exposed to view.

3. A cosmetic device including (a) a hand held case having first and second side surfaces and top, bottom, front and back surfaces and shaped and dimensioned to be concealed on the person;

(b) a first mirror mounted in said case;

(c) an elongate generally symmetrical channel in said case intermediate and generally parallel said top and bottom surfaces and opening at one of said side surfaces;

(d) a chemical solution reservoir shaped to slidably conform to said channel and having (i) a top, (ii) a bottom surface, and (iii) manually operated valve-nozzle means attached to said top for delivering under pressure from said reservoir chemical solution stored therein on the hair of an individual said reservoir normally being concealably stored in said channel such that said valve-nozzle means is positioned inside said channel, said valve-nozzle means being positioned for manual operation by slidably displacing said valve-nozzle means through said channel to an operative position outside of said case;

(e) an outwardly opening storage compartment bounded by said front and back surfaces and said mirror;

(f) a hair brush removably carried in said storage compartment and including a backing and bristles extending therefrom; said backing having an outer surface, said brush being movable between two positions, (i) a first storage position in said compartment with said brush concealing said mirror, with said outer surface of said backing generally comprising said top surface of said case, and with said bristles concealed inside said case adjacent said mirror, and (ii) a second position with said brush removed from said compartment to expose said mirror to view such that when said case is held in either hand of a user with said bottom surface of said case contacting the palm of the hand, the user can operate with the fingers of the hand said valve-nozzle means when said valve-nozzle means is slidably displaced to said operative position outside of said case, and view the user's head in said mirror by holding said hand in front of the user's face with the palm of the hand turned toward and opposed to the face.

4. The cosmetic device of claim 3 including (a) a second mirror having an outer peripheral edge; and, (b) a storage slot formed in said case and shaped and dimensioned to slidably receive and conceal said second mirror such that generally only a portion of said outer peripheral edge is exposed to view.

5. The cosmetic device of claim 3 wherein said brush is pivotally mounted in said case such that when said brush is moved to said second position, said backing and bristles extend away from said case and said outer surface is generally parallel to said mirror.

6. The cosmetic device of claim 5 including (a) a second mirror having an outer peripheral edge; and, (b) a storage slot formed in said case and shaped and dimensioned to slidably receive and conceal said second mirror such that generally only a portion of said outer peripheral edge is exposed to view.

* * * * *